US009092931B2

(12) United States Patent
Loose et al.

(10) Patent No.: US 9,092,931 B2
(45) Date of Patent: Jul. 28, 2015

(54) WAGERING GAME INPUT APPARATUS AND METHOD

(75) Inventors: Timothy C. Loose, Chicago, IL (US); James M. Rasmussen, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1048 days.

(21) Appl. No.: 13/162,402

(22) Filed: Jun. 16, 2011

(65) Prior Publication Data

US 2012/0149457 A1 Jun. 14, 2012

Related U.S. Application Data

(60) Provisional application No. 61/359,240, filed on Jun. 28, 2010.

(51) Int. Cl.

| | |
|---|---|
| ***G07F 17/32*** | (2006.01) |
| *A63F 5/00* | (2006.01) |
| *A63F 9/24* | (2006.01) |

(52) U.S. Cl.

CPC ..... *G07F 17/322* (2013.01); *A63F 5/00* (2013.01); *A63F 2009/241* (2013.01); *G07F 17/3209* (2013.01)

(58) Field of Classification Search

CPC ..... G07F 17/3209

See application file for complete search history.

(56) References Cited

U.S. PATENT DOCUMENTS

| | | | | |
|---|---|---|---|---|
| 5,431,408 | A | 7/1995 | Adams | |
| 6,762,752 | B2 | 7/2004 | Perski et al. | |
| 7,372,455 | B2 | 5/2008 | Perski et al. | |
| 7,803,051 | B2 | 9/2010 | Kuhn et al. | |
| 7,843,439 | B2 | 11/2010 | Perski et al. | |
| 8,199,114 | B1 * | 6/2012 | Jaeger et al. | 345/173 |
| 8,373,703 | B2 * | 2/2013 | Beckwith et al. | 345/467 |
| 2003/0098858 | A1 | 5/2003 | Perski et al. | |
| 2004/0155871 | A1 | 8/2004 | Perski et al. | |
| 2005/0049049 | A1 | 3/2005 | Griswold et al. | |
| 2005/0093837 | A1 * | 5/2005 | Singer | 345/179 |
| 2007/0171211 | A1 | 7/2007 | Perski et al. | |
| 2007/0285404 | A1 | 12/2007 | Rimon et al. | |
| 2008/0012835 | A1 | 1/2008 | Rimon et al. | |
| 2008/0170046 | A1 | 7/2008 | Rimon et al. | |
| 2008/0218494 | A1 | 9/2008 | Perski et al. | |
| 2008/0238879 | A1 * | 10/2008 | Jaeger et al. | 345/173 |
| 2009/0084612 | A1 | 4/2009 | Mattice et al. | |
| 2009/0095540 | A1 | 4/2009 | Zachut et al. | |
| 2009/0146975 | A1 * | 6/2009 | Chang | 345/179 |
| 2009/0184939 | A1 | 7/2009 | Wohlstadter et al. | |
| 2009/0251434 | A1 | 10/2009 | Rimon et al. | |

(Continued)

FOREIGN PATENT DOCUMENTS

| | | | |
|---|---|---|---|
| WO | WO-9809258 | A1 | 3/1998 |
| WO | WO-9809259 | A1 | 3/1998 |

(Continued)

*Primary Examiner* — Jay Liddle

(74) *Attorney, Agent, or Firm* — Nixon Peabody LLP

(57) ABSTRACT

Systems described herein include wagering game systems having one or more electrically responsive touch screens, and input devices for use with such touch screens. The disclosure addresses example configurations for such input devices that may be used to provide inputs to the wagering game system. The described input devices may be used to provide various input capabilities to the gaming assembly, and to thereby facilitate different configuration options of the gaming assemblies, including new operational options and functional capabilities.

22 Claims, 10 Drawing Sheets

(56) References Cited

U.S. PATENT DOCUMENTS

| | | | | |
|---|---|---|---|---|
| 2009/0273579 | A1 | 11/2009 | Zachut et al. | |
| 2010/0087241 | A1* | 4/2010 | Nguyen et al. | 463/17 |
| 2010/0130280 | A1 | 5/2010 | Arezina et al. | |
| 2007/0072664 | A1 | 9/2010 | Kuhn | |
| 2010/0222148 | A1 | 9/2010 | Kuhn et al. | |
| 2011/0111840 | A1* | 5/2011 | Gagner et al. | 463/25 |

FOREIGN PATENT DOCUMENTS

| | | | |
|---|---|---|---|
| WO | WO-03046882 | A1 | 6/2003 |
| WO | WO-03088164 | A1 | 10/2003 |
| WO | WO-2004070396 | A2 | 8/2004 |
| WO | WO-2005024739 | A1 | 3/2005 |
| WO | WO-2007144881 | A1 | 12/2007 |
| WO | WO-2008007372 | A2 | 1/2008 |
| WO | WO-2008045464 | A2 | 4/2008 |
| WO | WO-2008087638 | A1 | 7/2008 |
| WO | WO-2009045853 | | 4/2009 |
| WO | WO-2009047759 | A2 | 4/2009 |
| WO | WO-2009061952 | A1 | 5/2009 |
| WO | WO-2009093241 | A2 | 7/2009 |
| WO | WO-2009133559 | A2 | 11/2009 |
| WO | WO-2010006277 | | 1/2010 |
| WO | WO-2010039414 | | 4/2010 |
| WO | WO-2011004373 | A1 | 1/2011 |

* cited by examiner

FIG. 4A
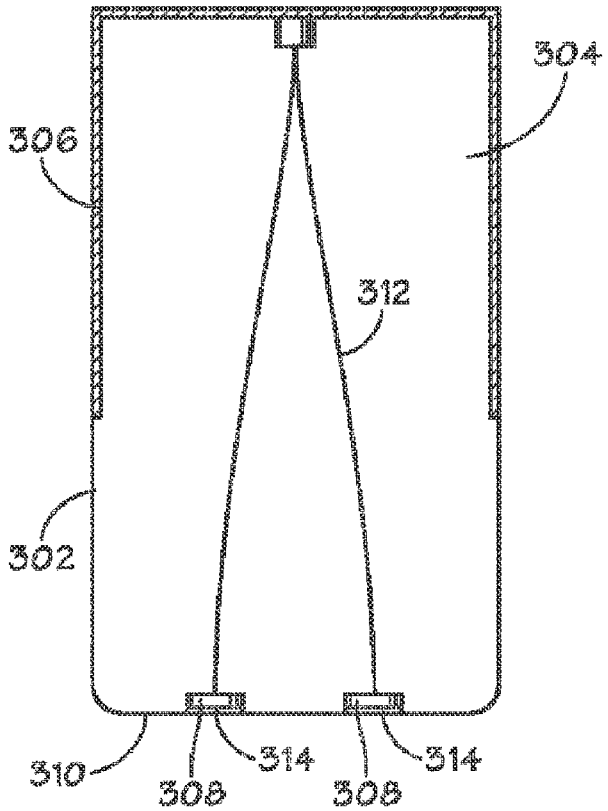
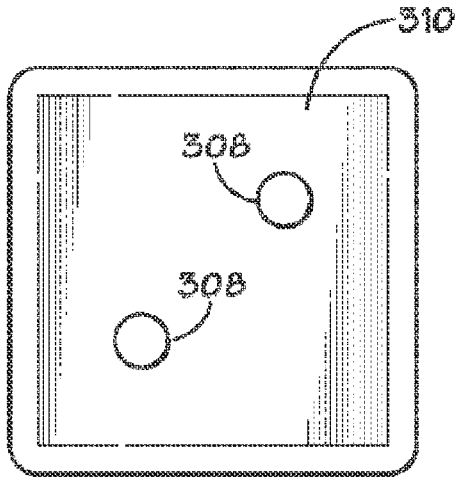
FIG. 4B
FIG. 5
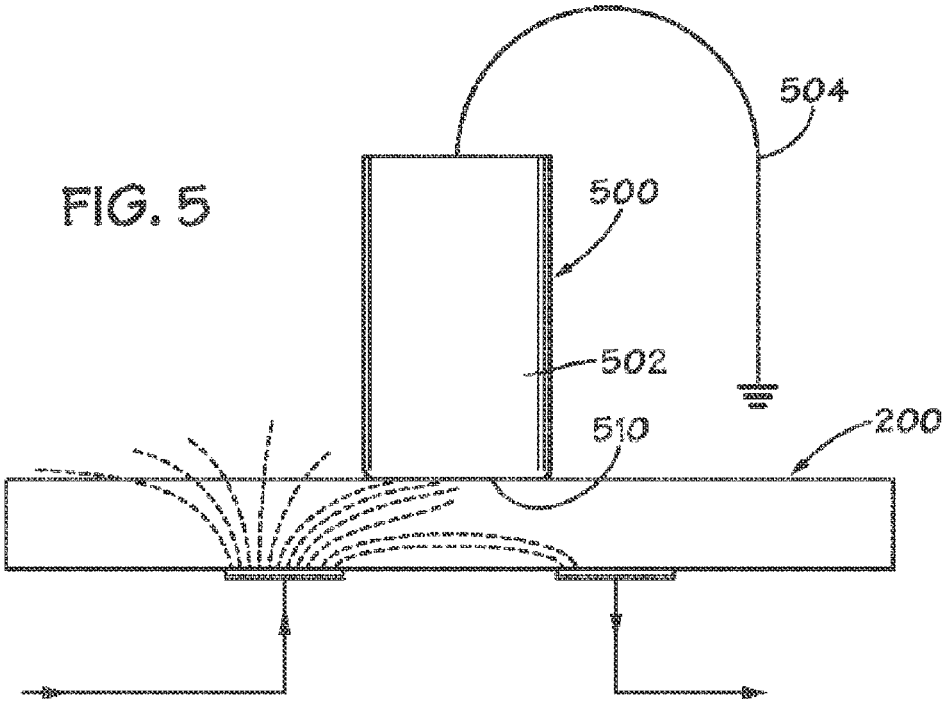

WAGERING GAME INPUT APPARATUS AND METHOD

CLAIM OF PRIORITY

This non-provisional patent application claims the benefit of priority under 35 U.S.C. §119(e) to U.S. Provisional Patent Application Ser. No. 61/359,240 filed on Jun. 28, 2010, entitled "WAGERING GAME INPUT APPARATUS AND METHOD," the specification of which is herein incorporated by reference in its entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, to input apparatus for such systems, and to methods for operating the game systems with such input apparatus; and more particularly relate to wagering game systems having an electrically responsive touch screen, and to input devices for use with such wagering game system touch screens.

BACKGROUND

Touch screens are known as a mechanism for receiving inputs to a processor-based system, i.e., a system using one or more processors, microcontrollers and/or digital signal processors (or other comparable devices) having the capability of executing a set of instructions (i.e., "running a program"). Such touch screens typically respond to the presence of a user contact or gesture to receive an input, as recognized through any one of several types of sensing mechanisms. For example, optical touch screen interfaces use imaging technology to detect the presence of a user, or the presence of an object moved by a user, relative to an input location on the screen. These optically-based touch screens can therefore operate without regard for the nature of the mechanism being sensed (for example, a user's hand). Other types of touch screens use electrical sensing to detect the presence or absence of a user input. These electrically responsive touch screens typically measure either a change in resistance or a change in capacitance between electrodes (or similarly functioning components) within the touch screen; where the change in resistance or capacitance results from a portion of a user's body in contact with or immediately adjacent an exterior surface of the touch screen, and thus in an operable relationship to the sensing electrodes. The present disclosure will address example configurations for input devices that may be used to provide inputs to a gaming assembly which includes this latter type of electrically responsive touch screen; and will identify various example input capabilities to the gaming assembly through use of such input devices. Additionally, also as will be set forth herein, the disclosure will describe novel gaming systems and gaming system functionalities made possible through use of the described touch screen input devices.

BRIEF DESCRIPTION OF THE FIGURES

Embodiments of the invention are illustrated by way of example and not limitation in the Figures of the accompanying drawings in which:

FIGS. 4A-B depict a functional representation of one example of an EID such as that of FIG. 3; functionally illustrated in FIG. 4A from a side cross-sectional representation, and illustrated in FIG. 4B from a bottom plan view.

FIG. 5 schematically depicts an alternative configuration of an EID in operable relation to an electrically responsive touch screen.

DESCRIPTION OF THE EMBODIMENTS

The following detailed description refers to the accompanying drawings that depict various details of examples selected to show how the present invention may be practiced. The discussion addresses various examples of the inventive subject matter at least partially in reference to these drawings, and describes the depicted embodiments in sufficient detail to enable those skilled in the art to practice the invention. Many other embodiments may be utilized for practicing the inventive subject matter other than the illustrative examples discussed herein, and many structural and operational changes in addition to the alternatives specifically discussed herein may be made without departing from the scope of the inventive subject matter.

In this description, references to "one embodiment" or "an embodiment," or to "one example" or "an example" are not intended necessarily to refer to the same embodiment or example; however, neither are such embodiments mutually exclusive, unless so stated or as will be readily apparent to those of ordinary skill in the art having the benefit of this disclosure. Thus, the present invention can include a variety of combinations and/or integrations of the embodiments and examples described herein, as well as further embodiments and examples as defined within the scope of all claims based on this disclosure, as well as all legal equivalents of such claims.

Example Touch Screen Wagering Game Assembly

Figure 1:
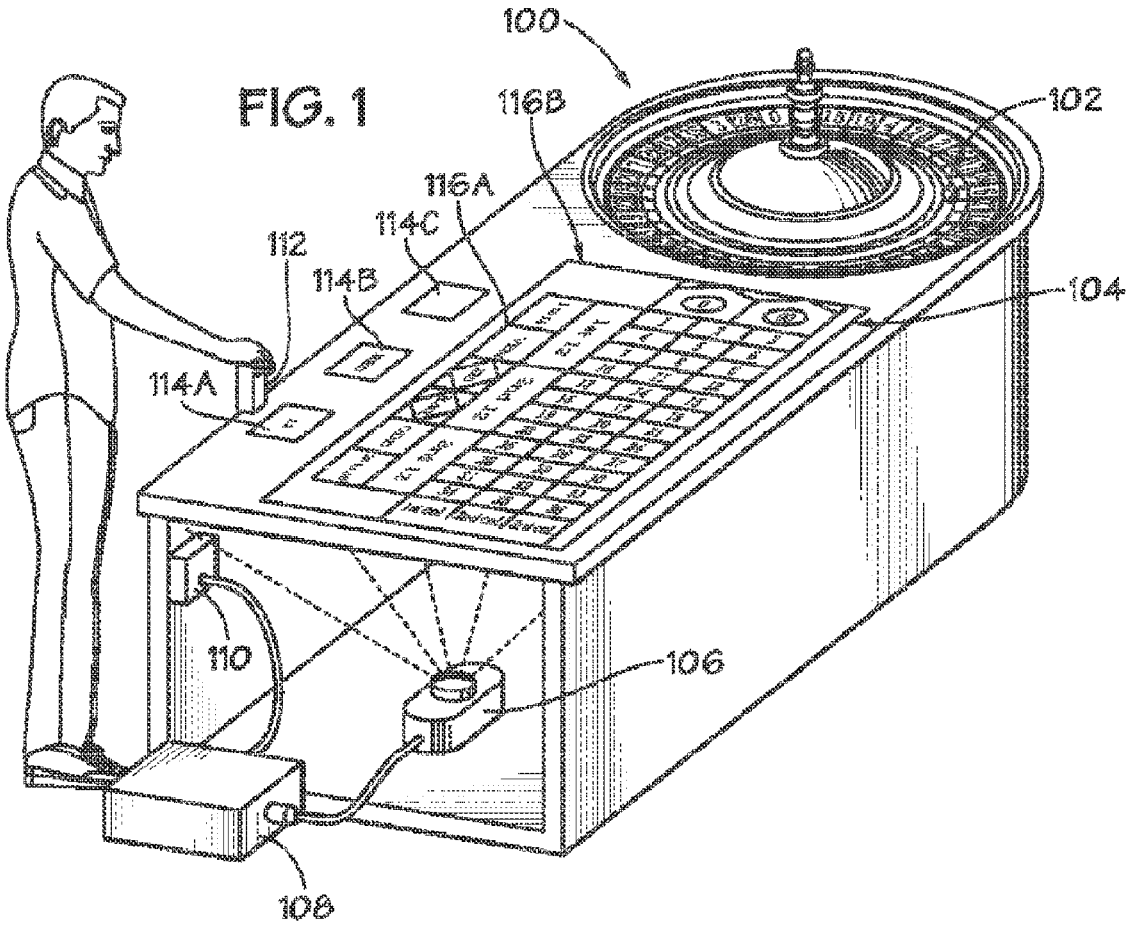
FIG. 1 depicts one example of a wagering game assembly that includes an electrically responsive touch screen, and is thus one example of a wagering game assembly which may beneficially be operated through use of a touch screen input device as described herein.

FIG. 1 depicts an example wagering game assembly 100, as one example assembly incorporating novel devices and methods as described herein. Wagering game assembly 100 is in the form of a roulette table, having a roulette wheel assembly, indicated generally at 102, and a betting board, indicated generally at 104, implemented as an electrically responsive touch screen. Thus, in this example wagering game assembly 100, bets will be placed through interaction with the touch screen of betting board 104, such as through pre-defined regions, e.g., 116A and 116B of betting board 104. Additionally, there may be separate input locations for receiving different types of inputs, as depicted generally at 114A-C.

As will be apparent to those skilled in the art of touch screens, stimulus inputs at specified locations (such as X and Y coordinates) on the touch screen will be applied as differing types of electrical inputs to the system; and the different specified locations will be graphically displayed to the player (and in many cases to all viewers). In some example systems, such as the wagering game assembly of FIG. 1, because betting board 104 displays the representation of a conventional graphic representation for a roulette betting board, bets can be accepted at each represented location (such as each graphically defined rectangular region of betting board 104), either through conventional placement of chips, or alternatively through use of an electronic input device (EID) 112, as described herein. Additionally, where an EID is used as an input, it will often be highly beneficial to the game play that the EID be a free-standing device, that will remain in a constant position and orientation on the underlying touch screen (such as standing upright at the location at which it is placed by a player), even when not held or otherwise supported by a player (in the same manner that a stack of chips will remain in place on a gaming table, and will be visible to all players). For example, in some systems, the EID may stand on the roulette betting board of FIG. 1 in place of one or more betting chips. In that application, since the location of the EID would indicate the type of the wager, it will be important that the EID maintain its place at the location where it is placed by a player. An advantage of the use of such an EID is that it can in some examples be used to enable machine-readable and recordable records of the wager type or amount, of the associated payer, etc., as will be described later herein.

In many example wagering game assemblies, such as that depicted in FIG. 1, a wagering game assembly may be dedicated to a single game. As a result, the touch screen would not necessarily include display capability, but could provide a touch-sensitive interface above a static graphic. Such a static graphic might either be permanently formed on a visible surface, or might be displayed electronically, such as through rear projection of a static display on an appropriate display surface. In the example of FIG. 1, the graphic representation of betting board 104 is projected from a projector 106 (or from multiple projectors), coupled to an appropriate control assembly 108 which will provide input signals necessary for the operation of projector 106; and may also be configured to control and/or perform the electrical functions of the wagering game assembly, as described later herein. For example, in some example configurations, control assembly 108 will include one or more processors operably coupled to one or more instances of machine readable storage media, to execute instructions stored on the machine readable storage media to provide necessary functions, such as for example, some or all of those functions described in reference to the example method of operation set forth in FIG. 11. Control assembly 108 is depicted as external to the remainder of wagering game assembly 100 to emphasize that the controller need not be actually located within the wagering game assembly, but could be located at a centralized, or other remote, location. Additionally, in some examples, control assembly 108 will be in communication with a communication module 110 that can facilitate electrical communication with other gaming machines or other control mechanisms in a gaming machine network, as described herein in reference to FIG. 14.

Although the example touch screen of FIG. 1 is implemented through display of a static graphic in combination with an overlying touch screen interface, in many other wagering game assemblies the touch screen may include an electronically writable display mechanism, such as (for example only) a thin film transistor (TFT) display, a light-emitting diode (LED) display, a liquid crystal display (LCD) or another type of appropriate display technology as will be known to those skilled in the art, in combination with an overlying touch screen assembly. In many instances these structures providing the touch screen interface and those providing the display functionality will be formed as a single composite unit. For clarity in the discussion herein, where there is a need to specifically refer to a structure with such a combined touch screen and display technology, the structure will be referred to as a "touch screen display;" and where there is a need to specifically refer to a touch screen not having built-in or directly-associated display capability, the device will be referred to as a "touch screen interface." Any of the wagering game assemblies described herein may be implemented through use of either a touch screen display or a touch screen interface; and thus the term "touch screen" as used herein should be clearly understood to generically embrace both such configurations. Additionally, the term "electrically responsive touch screen" is specifically used to refer to a touch screen wherein the "touch" input (which includes sensing of proximity in the absence of actual physical contact) is sensed electrically, and thus the term is used to distinguish optically-responsive touch screens.

In the described configurations of wagering game assemblies, all or some portion of the touch screen may be used to display customized messages, such as in response to the presence, movement, or placement of an EID on the touch screen surface. As just one example of such a wagering game assembly, the assembly could be configured to provide a virtual representation of a poker game to a plurality of players; and in this example assembly, virtual "cards" might be dealt electronically both to the community of players, through representation of cards in a central region of the touch screen, and individually to players, through representation of cards proximate each player (an example system of this type is addressed further in reference to FIG. 10). In such a system, one option that could be implemented to provide variety, and thus stimulation, to the players would be to allow customization of the playing surface in response to interaction with the touch screen, such as through use of an EID as will be described in more detail later herein. For example, by selecting an option through placement or actuation of an EID, a choice might be made to deal a different game, such as a different poker game, than that previously dealt; and that different game might be implemented through use of a differently patterned display associated with the touch screen (such as a playing surface), and/or through a different mode of game operation (such as through dealing the virtual "cards" in a different pattern from that used for a prior game). Additionally or alternatively, other types of options might be selected, such as different playing or wagering options, different audio, graphic and/or video themes or presentations, etc. Thus, the present disclosure contemplates using an EID not only for player input such as for establishing a wager, but also potentially for selecting parameters regarding the game, such as game appearance, play methodology, audio and/or video properties, or any other provided configurable parameter.

Figure 2A:
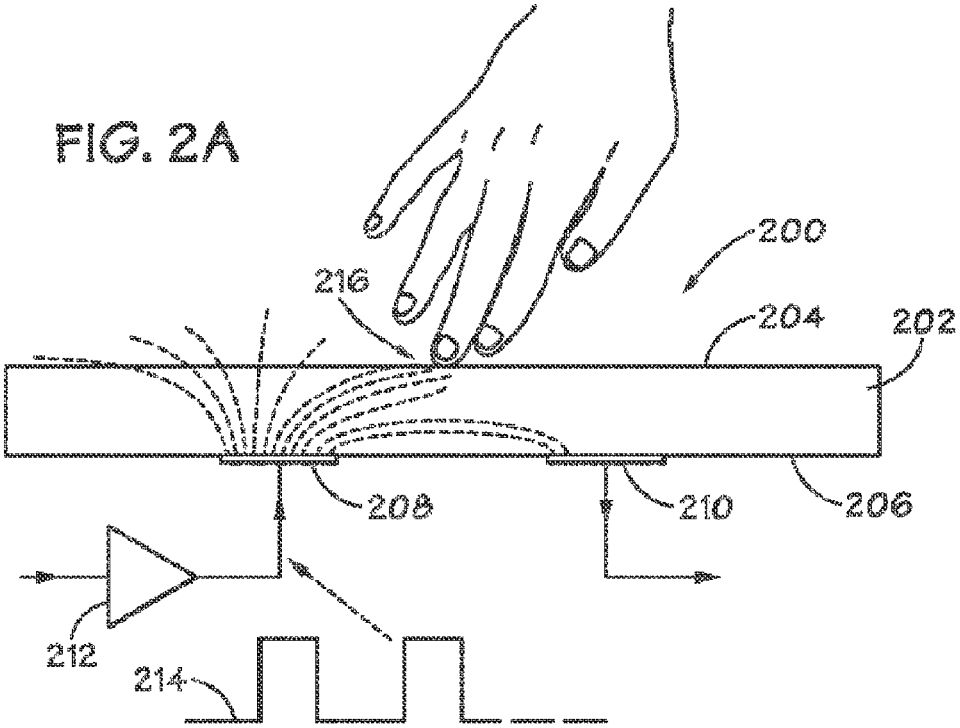
FIGS. 2A-B schematically depict examples of electrically responsive touch screens, responsive to a user's touch, functionally illustrated in FIG. 2A as a touch screen interface; while FIG. 2B functionally depicts the touch screen interface of FIG. 2A as part of a touch screen display.
Figure 2B:
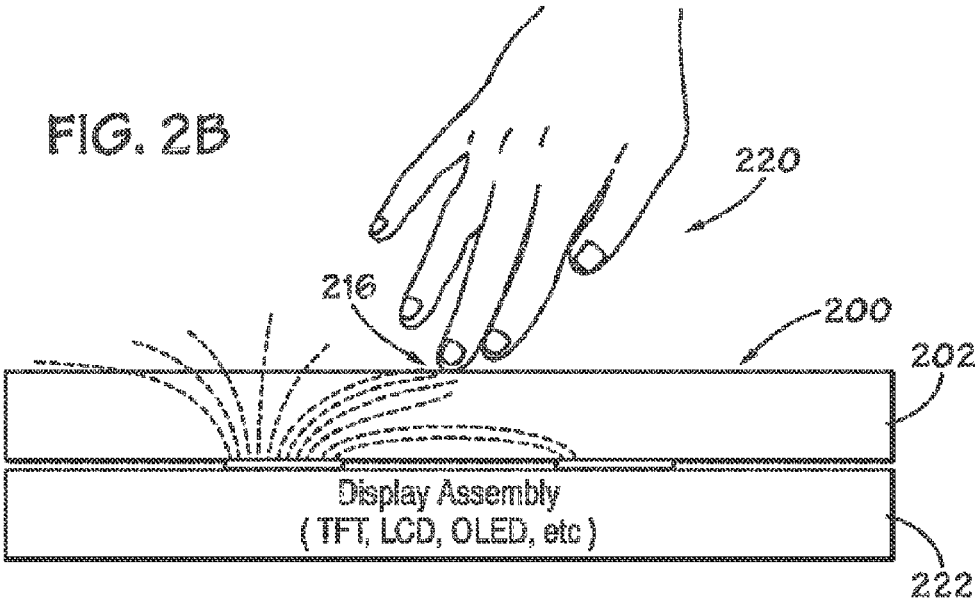

Referring now to FIGS. 2A-B, FIG. 2A schematically depicts the basic sensing components of a touch screen interface 200 as may be used in wagering game assemblies such as those discussed above. As will be apparent to those skilled in the art of touch screens, there are many conventionally known structures and operational methodologies for such screens; and thus this disclosure will repeat the descriptions of all the possible touch screen configurations. Although different types of electrically-responsive touch screens are contemplated for use, one example suitable type is that known in the art as a projected capacitance touch screen. Touch screen interface 200 is generally representative of many such systems. Touch screen 200 includes a dielectric front panel 202, such as a plastic or glass panel, which provides an outermost contact surface 204. At the rear surface 206, touch screen interface 200 includes one or more matrices of both drive electrodes 208 and receive electrodes 210. In many such systems, the electrodes may either be formed of extremely small structures which do not interfere with viewing of an image displayed through the touch screen, or the electrodes and other connecting circuitry may be formed of transparent conductive material (such as indium tin oxide (ITO)).

In operation, a drive assembly including a drive buffer 212, and typically additional circuitry, will provide a repetitive sensing signal, such as the depicted square wave 214, to a group or matrix of drive electrodes 208. When an electrical stimulus, such as the effective ground of a user, as indicated at 216, is placed proximate one or more of the electrodes 208, 210, that electrical stimulus will disturb the electrical field resulting from the sensing signal (such as square wave 214), thereby impacting electrical field coupling between one or more drive electrodes 208 and one or more receiving electrodes 210. In many such projected capacitance touch screen systems, the electrical stimulus will be the effective ground of a user's touch that sinks some of the charge generated by the drive electrodes; although some systems can be configured to operate through the injection of charge. Thus, the sensed signal from one or more receiving electrodes, reflecting this change in the field coupling (typically measured in the form of a change of capacitance), will be indicative of a user contact (although some systems may be configured to detect user proximity as a "contact"). Depending upon the precise mechanism used, the system may recognize the "electrical stimulus" of the touch to either add charge or reduce charge coupled between the identified electrodes. Additionally, in some examples, the system may be configured to measure a change in resistance rather than one in capacitance; though capacitance sensing systems are generally more prevalent. As will be apparent to those skilled in the art of touch screens, other evaluations can be made, such as requiring a minimum period of sensed "contact" to register a "touch input."

Many configurations of systems are now known for registering multi-touch and/or gesture inputs (for purposes of this description "multi-touch inputs" will be considered to include gesture inputs). Well known examples of such systems may be found in conventional smart phones and tablets (such as the iPhone and iPad, from Apple Inc.), which can register a number of simultaneous contact locations as user inputs, and can further respond to gestures of one or more inputs to provide desired functionality. Again as will be apparent to those skilled in the art of touch screens, the electrode matrices will often be somewhat more complex where the touch screen or touch screen display is configured to receive such "multi-touch" inputs, and typically to also respond to relative motion between the multiple inputs (as compared to the mechanisms necessary to receive only single touch inputs). While some wagering game systems may be implemented through use of single point inputs, the example configurations herein will describe the enhanced functionality that can be obtained through multi-touch stimulus inputs and detection.

FIG. 2B, functionally depicts the touch screen interface 200 as part of a touch screen display 220, and thus touch screen display 220 further includes a display mechanism 222 providing a conventional matrix of display pixels, as described above, in an operative association with touch screen interface 200. As noted previously, such a touch screen display will typically be formed as a single component, with the touch screen interface either formed together with or attached to the display mechanism 222. In such a touch screen display, the display mechanism 222 will often be placed immediately beneath touch screen interface 200; although in some examples, the components providing touch sensitivity and those providing display functionality can be integrated into a single assembly, which, in many cases may have some components of the two systems interleaved with one another.

Figure 3:
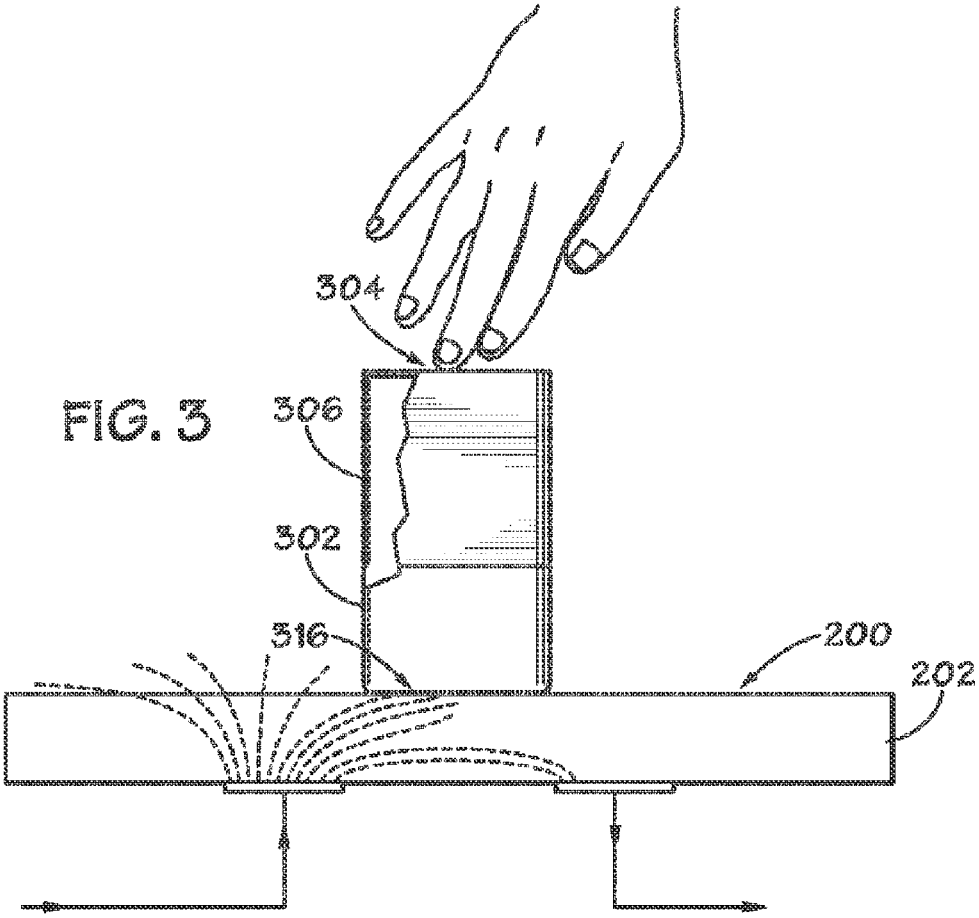
FIG. 3 schematically depicts an example electrical input device (EID) in operable relation to an electrically responsive touch screen.

Referring now to FIGS. 3 and 4A-B, FIG. 3 depicts touch screen interface 200 as described relative to FIGS. 2A-B, but in combination with an EID 302 serving as an intermediate member between a human contact point at 304 and an electrical stimulus provided to the touch screen 200, as indicated generally at 316. FIGS. 4A-B depict an example configuration for EID 302, illustrated in a functional cross-sectional view in FIG. 4A; and from a bottom view in FIG. 4B. As can best be seen in FIG. 4A, EID 302 includes a body member 304 which supports an upper conductive sheath 306. Body member 304 can be formed of any suitable dielectric material that can be conveniently shaped or formed into a desired size and configuration; and in many cases the material will be selected to provide a preferred weight for the EID. EID 302 further includes one or more conductive pads (i.e., electrodes) 308 proximate a lower contact surface 310. Conductive pads 308 can be formed flush with the remaining portion of lower contact surface 310. However, as depicted in the example of FIG. 3, each conductive pad is covered by a thin protective film 314 to protect the underlying touch screen surface (outermost surface 202 of touch screen 200), from scratching or abrasion by the conductive pads 308 (which will typically be metallic). Other alternative configurations are, of course, also possible for that purpose. For example, conductive pads 308 may be slightly recessed relative to the remaining portion of contact surface 310; or a protective film or coating could be applied across all of contact surface 310. Where a layer or coating is placed between conductive pads 308 and an underlying surface, that layer or coating should be nonconductive, and will preferably be as thin as feasible so as to not degrade the electrical stimulus applied through conductive pads 308.

Figure 8B:
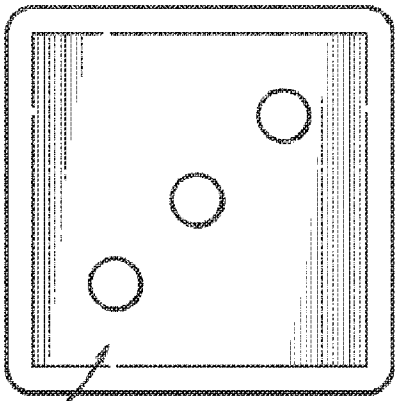
FIGS. 8A-C depict, in each figure, an example alternative configuration of electrodes for the bottom of EIDs, as might be used, for example, with any of the EIDs as described herein.
Figure 8A:
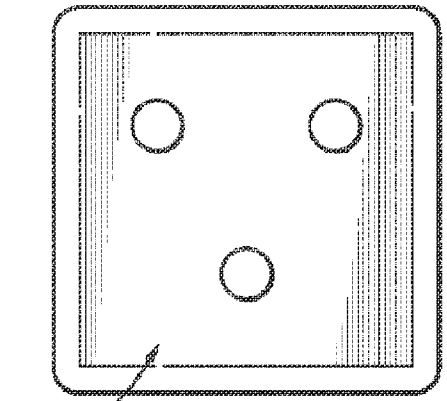
Figure 8C:
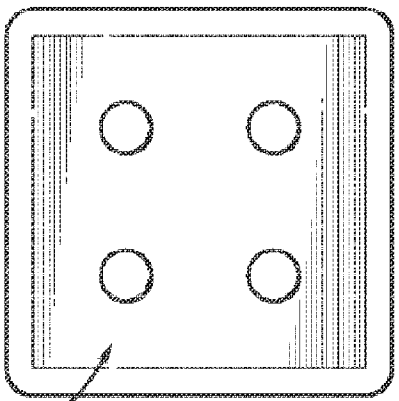

A single electrode 308 would be adequate to provide a single point input to touch screen 200, and thus may be suitable for some examples. However, in other examples, it will be preferable to provide multiple stimulus inputs through multiple contact pads, as the number, spacing and/or orientation of the stimulus inputs can then be used to differentiate between EIDs associated with different players of a wagering game assembly (one such example of a pair of spaced pads is depicted in FIG. 4B, and additional examples are depicted in FIGS. 8A-C). EID 302 also includes electrical conductors 312, such as wires, establishing continuing electrical communication between conductive sheath 306 and conductive pads 308.

In some examples, it may be desirable to form conductive sheath as two or more electrically isolated components, and to then separately couple each conductive sheath component to a respective conductive pad 308. Such configuration facilitates communication of different inputs in response to different types of user contact with either or both portions of the multi-component conductive sheath assembly. However, for many applications, that type of more complex input will not be necessary and would needlessly complicate the user's experience in learning to correctly contact EID 302 to provide the appropriate and desired electrical stimulus inputs to a touch screen.

Additionally, it should be recognized that as an alternative to the example configuration of EID 302, the high-level function of communicating an electrical stimulus from a user's touch to the touch screen 200 may be achieved through use of a EID which is merely a conductive material, such as for example, a metal cylinder; or which is a nonconductive component surrounded by a conductive coating or covering. While such devices are envisioned for use in accordance with the present description, it will be appreciated by those having the benefit of the present disclosure that such configurations will often not offer the option of providing multiple inputs at different locations, at least with a desirable level of resolution; and also may represent a fairly broad-based, and therefore low-resolution, input to the touch screen 200, as compared with other configurations of EIDs, as described and illustrated herein.

Figure 6:
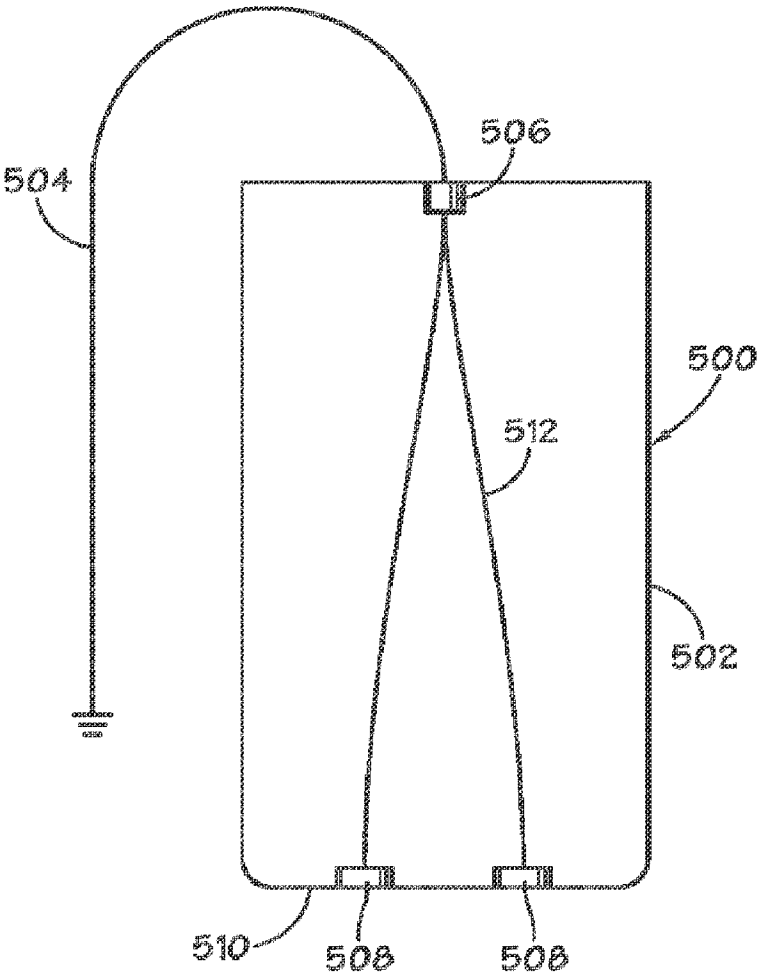
FIG. 6 depicts a representation of an example of an EID such as that of FIG. 5; functionally illustrated from a side cross-sectional view.
Figure 9A:
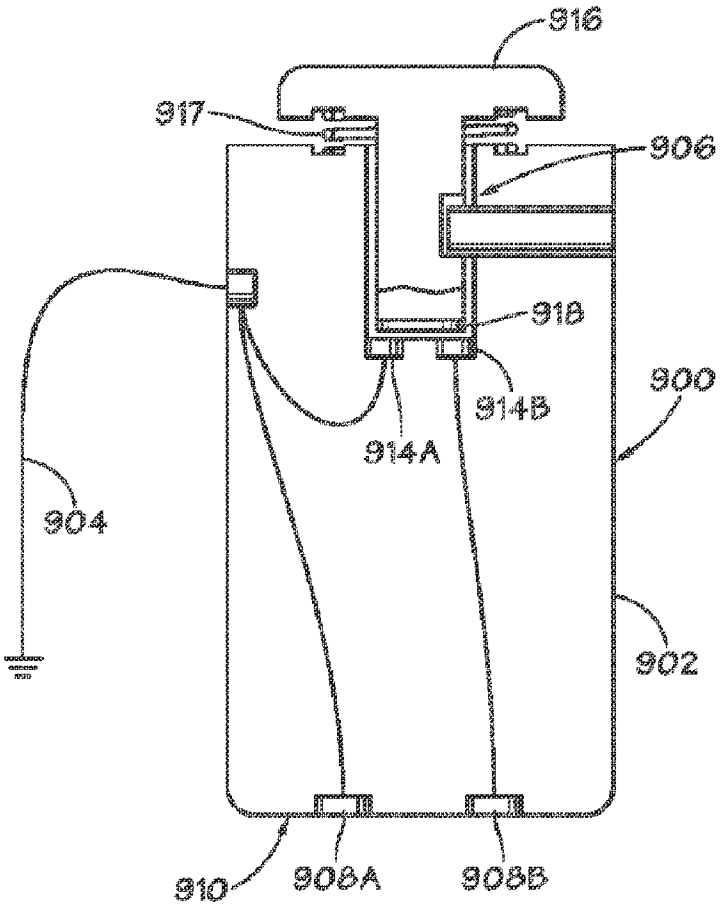
FIGS. 9A-E depict example alternative configurations of an EID, depicting a first configuration functionally illustrated from a side cross-sectional representation in FIG. 9A; with a second configuration functionally illustrated from a side cross-sectional representation in FIG. 9B; and with examples of bottom contact surface configurations depicted in the respective bottom plan views of FIGS. 9C-E.

Referring now to FIGS. 5 and 6, FIG. 5 depicts an alternative configuration of an EID 500, again in operating contact with touch screen interface 200. Of course, the human body is not the only source of an electrical signal that may be used to generate the electrical stimulus that will interact with the underlying touch screen. As one alternative example, EID 500 again includes a body member 502, and one or more contact pads 508 proximate a lower contact surface 510. However, EID 500 is configured to couple to a voltage reference, such as a ground potential, from an external location, through a conductive tether 504 coupled through an appropriate connector 506 to conductive elements 512 coupled to contact pads 508. Thus, as referenced earlier herein, in many examples systems, the voltage reference to ground will serve to draw or "sink" charge from the touch screen drive and sensing mechanism, and to thereby provide an "electrical stimulus" input of two spaced contact locations to the touch screen. Conductive tether 504 will be housed within an insulative sheath (and will thus typically be an insulated cable or wire) in order to avoid unintended inputs to the touch screen as might occur through contact of an uninsulated conductor with the underlying touch screen.

One advantage of an EID constructed in a manner similar to EID 500 is that the electrical stimulus input to the touch screen through conductive pads 508 is continuously present regardless of contact of a user with EID 500, as the voltage reference is continuously applied through tether 504. A possible disadvantage, however, for some applications is that the conductive tether 504 may be subject to unintended movement that could alter the position or orientation of EID 500 relative to an underlying touch screen, such as by a person at the wagering game assembly snagging or otherwise unintentionally moving the tether, and thus the attached EID.

Figure 7:
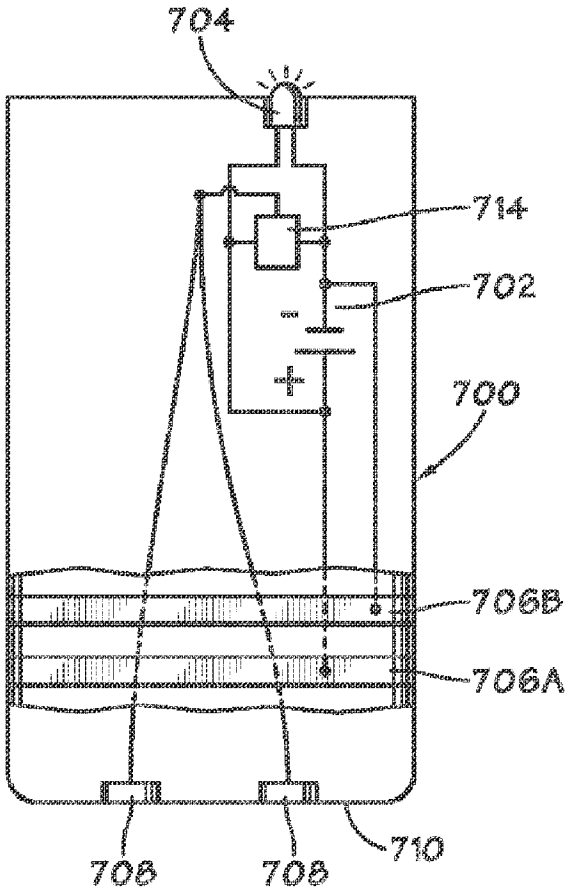
FIG. 7 depicts a representation of an example an alternative configuration of an EID, functionally illustrated from a side, partially cross-sectional, view.

Referring now to FIG. 7, the figure depicts an alternative configuration for an EID 700 that offers the continual input advantage of EID 500, but avoids the requirement of a tether 504. EID 700 includes a power source, such as a rechargeable battery 702, that may be coupled across a relatively low current draw load, such as a signal generator 714, and, alternatively, an indicator LED 704. The signal generator 714 be implemented through a variety of mechanisms to provide a varying electrical signal that will be coupled to contact pads 708. Signal generator 714 can be fairly relatively simple, such as an oscillator assembly, or could be implemented through more complex assemblies to provide a desired time-varying electrical signal that will provide an electrical stimulus input to the underlying touch screen. In this configuration, the varying electrical signal from signal generator 714 will provide the electrical stimulus to the underlying touch screen through contact pads 708; and that signal is provided entirely from within EID 700, and thus no external tether is necessary. An additional feature that will advantageously be included in at least some examples in accordance with this description is at least one pair of external contacts, depicted here as conductive bands 706A and 706B, extending circumferentially around body member 706. As will be appreciated by those skilled in the art, the provisions of external contacts such as conductive bands 706A and 706B will facilitate engagement of EID 700 with an appropriately complimentary recharging base (not illustrated), configured to make electrical contact with the conductive bands to recharge battery 702. Additionally, LED 704, in addition to providing a continuous load across the battery, can provide an externally visible indication that EID 700 is generating an electrical signal, and is therefore in an operative state.

Referring again to FIG. 4B, and also to FIGS. 8A-C, the figures depict example alternative arrangements and configurations for bottom contact pads for the contact surface of EIDs, as described herein. In the example of FIG. 4B, even simple pairs of electrodes may be arranged at different spacings relative to other pairs, to provide differently spaced touch inputs, and thus machine-determinable distinctions between EIDs. EIDs may also be formed with different numbers and/or patterns of contact pads: 3 in each of contact pad patterns 802 and 804 FIGS. 8A-B, and 4 in pattern 806 FIG. 8C). Additionally, different spacings of the arrangements of contact pads in each of these identified example patterns may be used to provide additional differences in the resulting placement of electrical inputs to an associated touch screen that may again serve to provide machine-determinable differences between EIDs (such as, for example, those associated with different players). In some cases, the position of the electrodes may be arranged on each EID, and then recognized by the touch screen, to allow determining orientation of the EID (as discussed in reference to FIG. 10).

Referring now to FIGS. 9A-E, FIG. 9A depicts yet another configuration of an EID 900, again depicted in a functional cross-sectional view. EID 900 is configured to allow additional forms of input, in the form of a positive selection actuation, which will result in an electrical stimulus being applied to an underlying touch screen. EID 900 again includes a body member 902, with one or more electrodes 908A, 908B proximate a lower contact surface 910. As with EID 500, EID 900 includes a conductive tether 904 to an external voltage potential, here ground potential. EID 900 also provides a switch mechanism, indicated generally at 906, which includes at least one pair of conductive terminals 914A and 914B, operatively arranged relative to a movable switch member 916, represented here by a plunger, movable from a first position, in which the switch is open, to a second position wherein the plunger is relatively depressed, and a conductive switch member 918 on plunger 916 contacts conductive terminals 914A and 914B, thereby establishing electrical communication through switch 906 to contact pad 908B. A return mechanism, such as a resilient member 917 (for example a spring or foam element having a "memory" to return to an original dimension), can be used to bias plunger 916 towards the uppermost or non-actuated ("switch open") position.

A variety of electrical configurations may be implemented in EID 900. In the depicted example, one contact pad 908A is in constant electrical communication with the tether-supplied voltage potential, and the other contact pad 908B, is in selective communication through the operation of the described switch mechanism 906. As a result, EID 900 will provide one electrical stimulus input to an underlying touch screen wherever it is placed, and will supply a second electrical stimulus (through contact pad 908B) only in response to a user action (depressing the movable switch member 916), to communicate the voltage potential to conductive pad 908B. As an alternative configuration to the tethering of EID 900, an internal battery may be utilized to provide the voltage potential, in a manner similar to that described relative to EID 700 of FIG. 7.

Figure 9D:
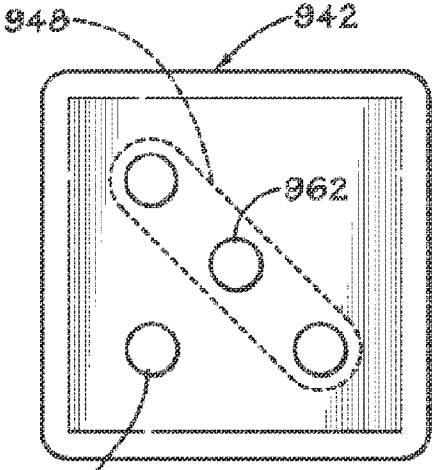
Figure 9C:
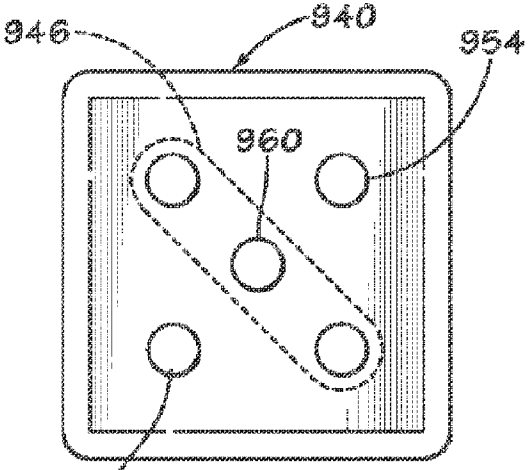
Figure 9E:
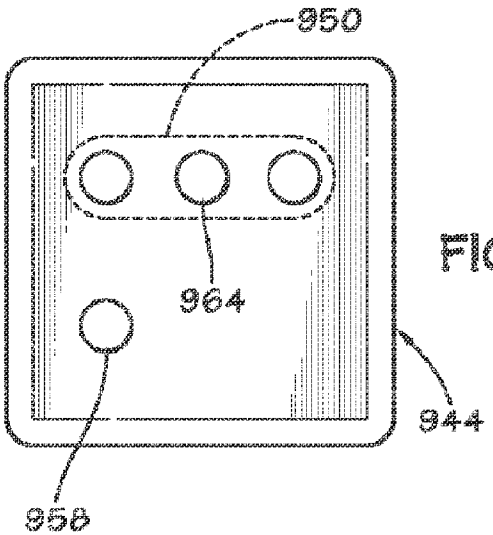
Figure 9B:
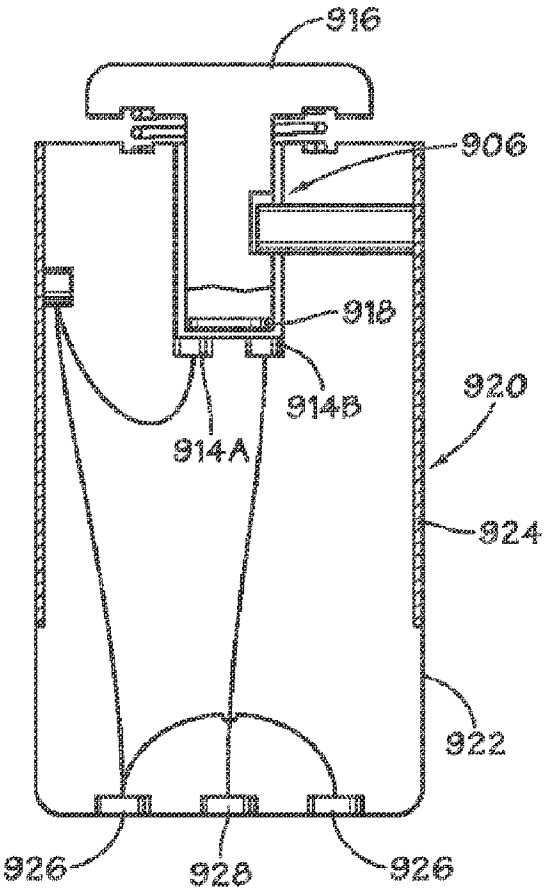

FIG. 9B depicts an alternative configuration of an EID 920 also configured to enable a positive selection input from a user. EID 920 again includes a body member 922 and a switch assembly 906 as described in reference to FIG. 9A. EID 920, however, includes an external conductive sheath 924 on body member 922, to make electrical contact with a user, in the manner as described above relative to FIGS. 3 and 4A-B. EID 920 includes two input mechanisms, implemented as two groups of contact pads 926 and 928. In this example, a first group of contact pads 926 (which may be only a single contact pad), is electrically coupled to the conductive sheath 924, and thus will provide electrical input to an underlying touch screen whenever a user is in contact with the sheath. One or more additional contact pads form the second group of contact pads 928 (depicted here as a single contact pad). Contact pad 928 is only in communication with sheath 924 through actuation of switch assembly 906. Thus, when a user is contacting EID 920, an underlying touch screen will detect inputs from contact pads 926. A user may then press plunger 916 to close switch 906, and to thereby couple sheath 924 to contact pad 928, and to thereby provide a positive selection input to an underlying touch screen.

Referring now primarily to FIGS. 9C-E, therein are depicted example configurations for contact surfaces that could be used with either of EID 900 or EID 920. Because these examples illustrate particular functionality achievable through use of EID 920, the example configurations will be described relative to that device. As can be seen from FIGS. 9C-E, each of the respective contact pad configurations, 940, 942 and 944, respectively, includes a plurality of contact pads. As an example of one possible configuration, it can be seen that each contact pad configuration 940, 942 and 944 includes at least one row that includes three aligned contact pads 946, 948, 950, plus at least one additional contact pad 952, 954, 956, 958 (FIG. 9C contact pads 952 and 954 might be considered as part of such a three pad row, with the outermost contact pads of aligned group 946 being construed as the "additional" pads). This type of configuration provides examples (out of many conceivable additional examples) wherein all but one contact pad of an EID such as EID 920 might be connected in a first group to provide an identifying pattern, and where the one additional contact pad will be coupled through a user-controllable switch mechanism to enable input of a positive selection signal. For example, in the example configurations 940, 942, 944, the center-most contact pad 960, 962, 964 of each aligned group of three pads 946, 948, 950 might be coupled through the switch mechanism to provide the positive selection input, while the remaining contact pads in each configuration will provide a unique pattern, which may each be configured to be unique within a set of EIDs associated with a particular wagering game assembly.

Figure 10:
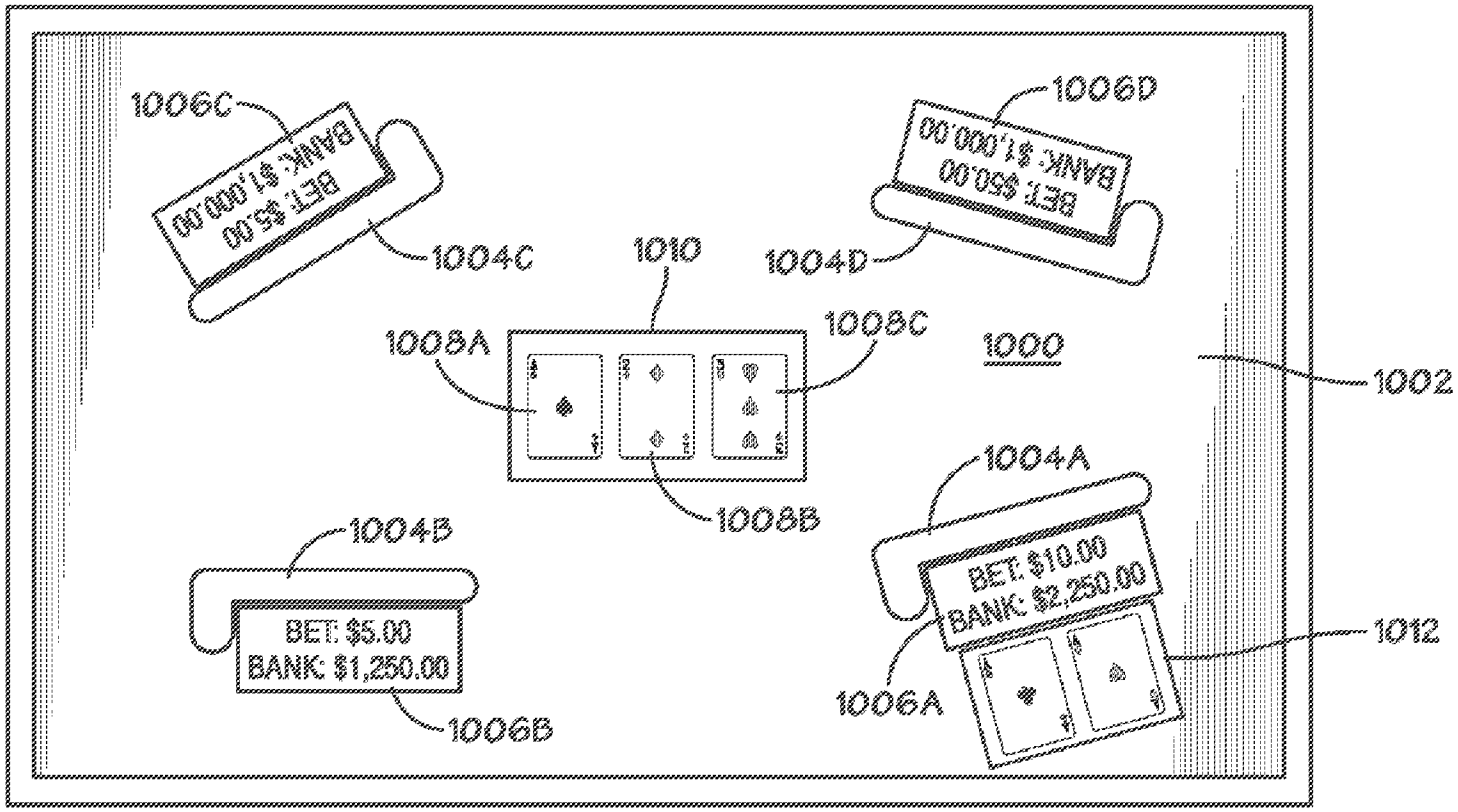
FIG. 10 depicts an example wagering game assembly playing surface comprising an electrically responsive touch screen, in combination with a plurality EIDs of yet another example configuration.

Referring now to FIG. 10, the figure depicts an example wagering game assembly playing surface 1000 comprising an electrically responsive touch screen in the form of a touch screen display 1002, in combination with a plurality EIDs 1004A-D, of yet another example configuration. In this example, each EID 1004A-D is of a shape (an "L-shape") that facilitates a presentation of electrical stimulus input locations that indicates the position and orientation of the EID; and each EID 1004A-D may again include a separate pattern of contact pads, in a manner similar to that depicted relative to FIG. 8A-C, which can be associated with a particular user. The association may be made through use of a reference depository, such as a database, either retained within the wagering game assembly itself, or the rest separately accessible depository, such as a casino database.

As just one example of many types of wagering game customization that may be accomplished through use of the various configurations of EID as discussed herein, when a wagering game player places the EID on the electrically responsive touch screen display 1002, the display can show a "bank area" reflecting information customized to that player (1006A-D), for example the amount of money or credits remaining in their pool or "bank" for play, the size of their bed, the minimum bet, etc. This type of player-specific information can be displayed automatically, or in the circumstance of an EID which includes the capability of providing a selectively actuable electrical stimulus, can be provided only in response to a user's actuation input.

Yet another example of wagering game customization that might be achieved through use of an EID providing selected user actuation, is provided in a virtual card game, as discussed earlier herein. In such a configuration, one or more community cards 1008A-C may be (virtually) dealt in a community area 1010, and one or more "hole cards" might be dealt to a player face down in a player-specific area 1012, as determined by placement of an EID. Actuation of an EID to provide an additional player input can be used to signal a reveal of the player's hole cards, and to then again conceal the cards in response to de-actuation of the EID.

Example Wagering Game Machine Operations Through Use of an EID

Figure 11:
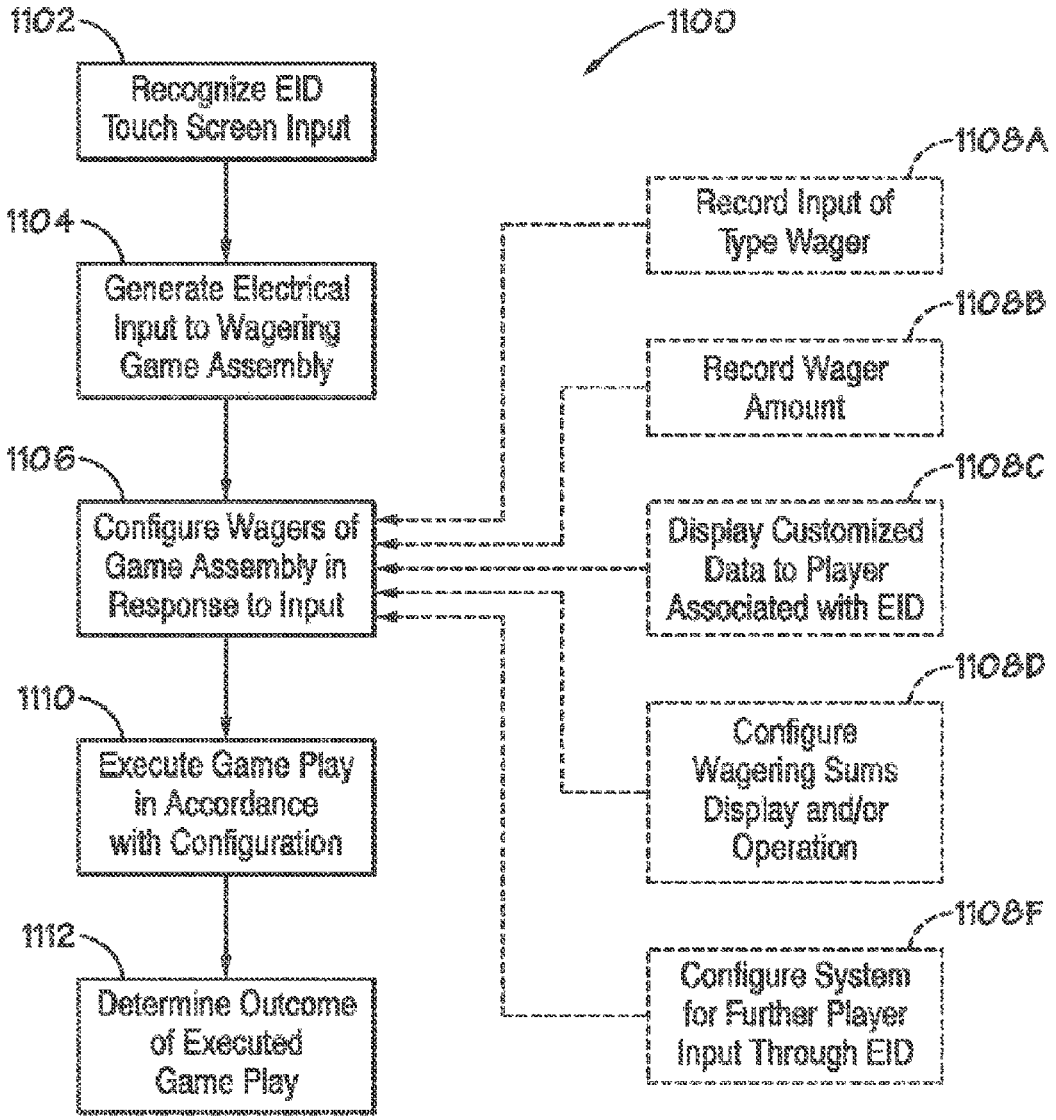
FIG. 11 depicts a flow chart of an example method for operating a wagering game assembly through use of an EID.

Referring now to FIG. 11, that figure depicts a flowchart 1100 of an example method of operation of a wagering game assembly including an electrically responsive touch screen, and that further includes use of one or more EIDs as described herein. The described flowchart 1100 does not address conventional sequences for booting the gaming machine and preparing it for performing the gaming operations. Accordingly, at a first step 1102, the gaming machine will recognize a touch screen input resulting from an electrical stimulus supplied through an EID. As noted previously, in some example configurations, the gaming machine may be capable of receiving inputs both through direct contact with the touch screen, and as supplied through an EID. One can envision that in some examples, a gaming machine might not be configured to readily distinguish certain types of direct electrical stimulus inputs from human contact from electrical stimulus inputs conveyed by an EID. However, many such systems can be configured to make such distinctions, for example based upon the size, number, arrangement and/or movement (relative or otherwise) of the electrical stimulus inputs. Such distinctions are considered to be well within the skill of those skilled in the art of touch screens.

After the gaming machine receives the touch screen stimulus input, the input will be processed (at step 1104) in a conventional manner, in correspondence to the assigned input function for the location of the stimulus input (which, in most cases, will correspond to a displayed indication of the functionality for that location, or the region in which the location is found), to provide an appropriate electrical input for use by the one or more CPUs or other processing circuitry in the gaming machine. In most circumstances, the electrical stimulus input, and thus the resulting electrical system input, will be for the purpose of configuring the gaming machine in some manner; and thus, at step 1106, the gaming machine will be configured accordingly, in response to the stimulus input. As is apparent from the preceding discussion herein, this configuration can be of one or more of a number of possible configuration choices. For example, a number of possible configuration parameters are indicated in the optional flowchart steps 1108A-E; and the configuration of step 1106 may include one or more of these configuration types, as well as others not specifically described.

By way of example, the configuration change resulting from the touch screen stimulus input may include recording the type of wager, as indicated at step 1108A. Going back to the example of FIG. 1, of a roulette game, the type of wager in that example might be a wager on a single number, as opposed to a wager on a group of numbers, or a wager on a color of numbers, as determined by the placement of the EID on the betting board (104, in FIG. 1). Alternatively, the configuration change might be a recording of a wager amount for a player associated with the EID through which the input is placed, as indicated at step 1108B.

Another alternative type of configuration change might be to cause the gaming machine to display customized data to a player associated with the EID through which the input is placed, as indicated at step 1108C. This type of configuration was described in reference to FIG. 10, with the display of data specific to the player associated with each EID. Yet another type of configuration change is to configure the wagering game display and/or operation, as indicated at step 1108D, as was discussed previously in the example of a player making a choice of a type of game to be dealt in a virtual card game, which can then (depending upon the game choice made) influence (for example) the display of the playing table and/or the dealing pattern and placement of the (virtual) cards. And as yet another example, the configuration change might be to configure the system for further input through the EID, at step 1108E. As just one example of such configuration, the recognition of a stimulus input from an EID at a given location on the roulette game of FIG. 1 could configure the system by recording a type of the bet (as described at step 1108A), and the number or numbers that will be the subject of the bet; and then configure the system to receive a number of actuation motions as might be applied by a player through the EIDs of FIGS. 9A-B, to record the amount of the bet. As just one example, each press of the actuation mechanism might increment the amount of the bet by a predetermined amount (for example, five dollars per input), so a series of four presses would input a bet amount of $20 for recordation by the system. To further expand upon this example, in some example operations, as a player increments the bet amount, the amount of the bet can be displayed to the player through the touch screen, either proximate the players associated EID or in an otherwise defined region of the touch screen. Of course, any of these example operations, as well as others that may be envisioned, may be performed multiple times (such as at least once for each player participating in the gaming session).

Once the wagering game assembly has been configured in accordance with step 1106 (and potentially with one or more of steps 1108A-E), then the game play will be executed in accordance with that configuration, as indicated at step 1110. Where the configuration includes, for example, an entry of the wager type and/or amount, such execution, at least as to that configuration could possibly include simple recordation of the wager type/amount, such as might be used for determining the outcome of the executed game play as at step 1112. Such determining of the outcome might be relatively straightforward, such as through comparison of the type of the wager to a separate gaming result (for example, as in the case of the wagering game assembly of FIG. 1, the color and number result of the spin of the roulette wheel). Such comparison might be performed manually, or in many systems, might be performed automatically either in the wagering game assembly or external thereto. As will be apparent to those skilled in the art having the benefit of the disclosure, both the execution of the game play based upon an electrical input to the wagering game assembly, and the determining of the outcome of that game play may also involve many additional variables, some examples of which are described elsewhere herein.

Example Operating Environment

Example Wagering Game Machine Architecture

Figure 12:
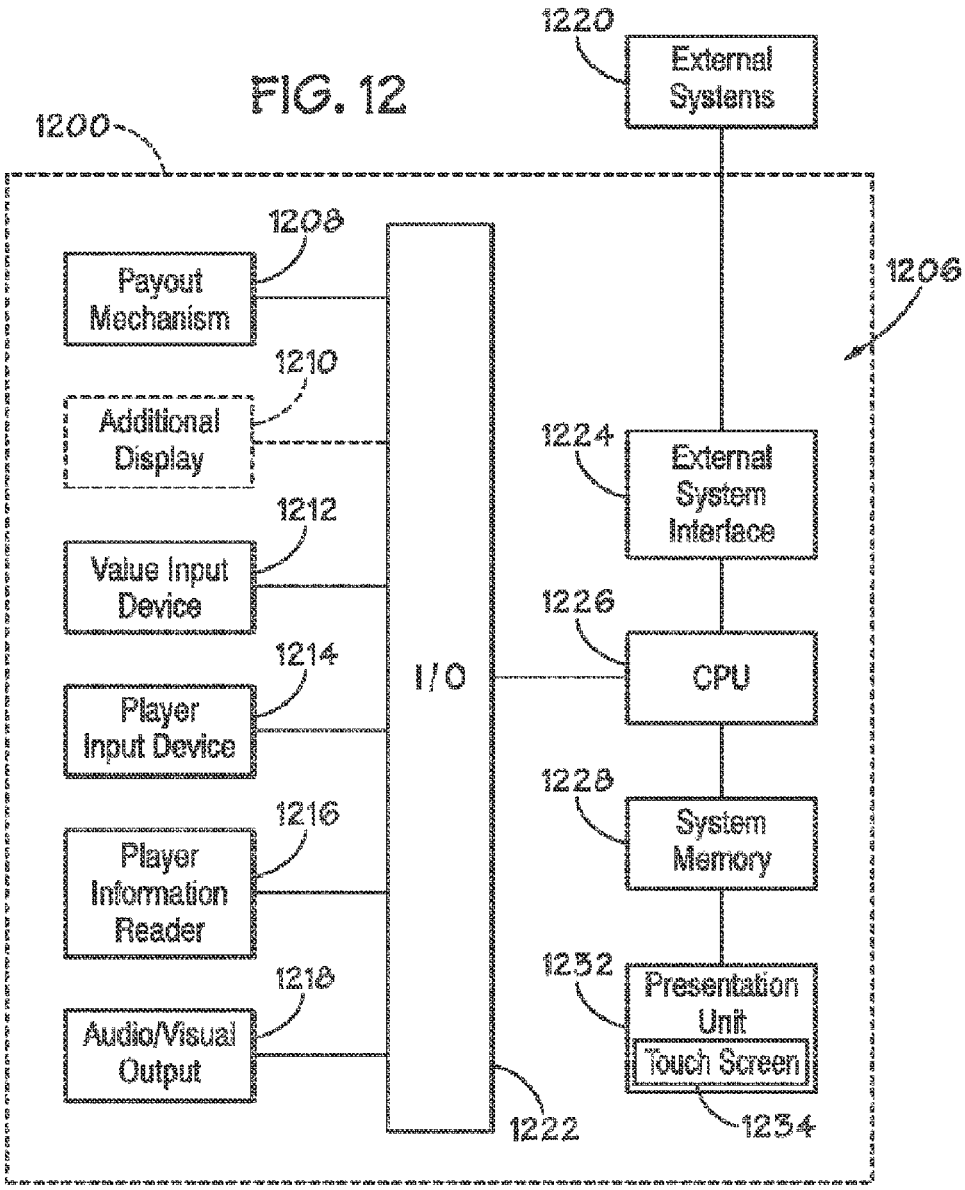
FIG. 12 schematically depicts a representation of one example of a wagering game assembly.

FIG. 12 is a block diagram representation of an architecture of an example wagering game machine 1206, including a control system, according to example embodiments of the invention. As shown in FIG. 12, the example wagering game machine 1206 includes a central processing unit (CPU) 1226 connected to system memory 1228, and a wagering game presentation unit 1232, which will include the described electrically responsive touch screen 1234, as well as the interfaces necessary to process inputs placed through the touch screen 1234. The wagering game presentation unit 1232 will also include interfaces necessary to provide visual elements (static or video) that will be displayed through the touch screen or through additional component(s). Thus, in some example systems, wagering game presentation unit 1232 may include components such as the projector 106 and control assembly 108 of the wagering game machine of FIG. 1. As noted previously herein, wagering game presentation unit 1232 can present wagering games at least in part through display functionality associated with the touch screen, such as, for example, the previously described roulette and "virtual" or video poker, blackjack, keno, etc. While many examples of wagering game assemblies that will benefit most from use of EID inputs as described herein are envisioned to be multiplayer games, the use of EIDs is also contemplated for single player games having electrically responsive touch screens.

In this example configuration, the CPU 1226 is also connected to an input/output (I/O) bus 1222, which facilitates communication with and between the wagering game machine's additional components. It should be clearly understood that many wagering game machines will not include all of the described components; and that components need not be connected through a single bus, or through a bus at all. In this illustrative example, the I/O bus 1222 is connected to a payout mechanism 1208, an additional display 1210 (which may be either a touch screen display or a conventional display), a value input device 1212, a player input device 1214, and a player information reader 1216 and other output devices, such as audio/visual outputs 1218. The I/O bus 1222 may also be connected to an external system interface 1224, which is connected to external systems 1220 (e.g., wagering game networks).

When present, the value input device 1212 can include, for example, a reader configured to receive credit from a stored-value card (e.g., casino card, smart card, debit card, credit card, etc.) inserted by a player. The value input device 1212 can also comprise a sensor (e.g., an RF sensor) configured to sense a signal (e.g., an RF signal) output by a transmitter (e.g., an RF transmitter) carried by a player. The value input device 1212 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 1206. Still other value input devices 1212 can require the use of touch keys on the touch screen (e.g., either the primary touch screen or a supplemental touch screen 1210). Upon entry of player identification information and, preferably, secondary authorization information (e.g., a password, PIN number, stored value card number, predefined key sequences, etc.), the player can be permitted to access a player's account. As one potential optional security feature, the wagering game machine 1206 can be configured to permit a player to only access an account the player has specifically set up for the wagering game machine 1206. Other conventional security features can also be utilized to, for example, prevent unauthorized access to a player's account, to minimize an impact of any unauthorized access to a player's account, or to prevent unauthorized access to any personal information or funds temporarily stored on the wagering game machine 1206.

The player input device 1214 can include the value input device 1212 to the extent the player input device 1214 is used to place wagers. Where inputs and/or wagers are received through the touch screen, as described herein, in many example systems, there may be no need for a separate player input device. In some examples, the wagering game machine 1206 will include a player information reader 1216 that facilitates identification of a player by reading a card with information indicating the player's identity (e.g., reading a player's credit card, player ID card, smart card, etc.). Such player information reader 1216 can alternatively, or also, include a bar code scanner, RFID transceiver or computer readable storage medium interface. In one embodiment, the player information reader 1216 comprises a biometric sensing device. Another application of the player information reader 1216 may include a reader, such as an RFID interrogator, to read an RFID tag in an EID, and to thus verify that the player using the EID is the person associated with the EID. In one example of a system using such an RFID, each EID would have a unique RFID identifier associated with it; and only certain EID identifiers would be registered for use, either with a specific wagering game machine, or, as alternative example, within a portion of the casino. If the RFID interrogator were to identify an unauthorized EID, or to fail to identify an appropriate number of EIDs relative to the number of EID input locations registered on the touch screen, appropriate security or further examination steps might be triggered. Thus, such RFID interrogation of an RFID-tagged EID can be used to assure that all EIDs used with a specific wagering game machine are assigned or registered for use with that wagering game machine, or with that type or group of wagering game machines.

In one embodiment, the wagering game machine 1206 can include additional peripheral devices and/or more than one of each component shown in FIG. 12. For example, in some cases, the wagering game machine 1206 can include multiple external system interfaces 1224 and multiple CPUs 1226. In one embodiment, any of the components can be integrated or subdivided. Additionally, in one embodiment, the components of the wagering game machine 1206 can be interconnected according to any suitable interconnection architecture (e.g., directly connected, hypercube, etc.).

In one embodiment, any of the components of the wagering game machine 1206 can include hardware, firmware, and/or software for performing the operations described herein. Where functionality is preformed at least in part through execution of instructions retained in software and/or firmware, those instructions will be stored (in the machine or in another component) in one or more instances of machine-readable storage media. Machine-readable media includes any mechanism that provides (e.g., stores and/or transmits) information in a form readable by a machine (e.g., a wagering game machine, computer, etc.). Machine-readable media thus includes any media suitable for transmitting software over a network. The above-mentioned "machine readable storage media" is a subset of such machine-readable media, and includes any form of tangible storage media capable of storing data and/or instructions, including, for example, read only memory (ROM), random access memory (RAM), magnetic disk storage media, optical storage media, flash memory devices, etc.

Figure 13:
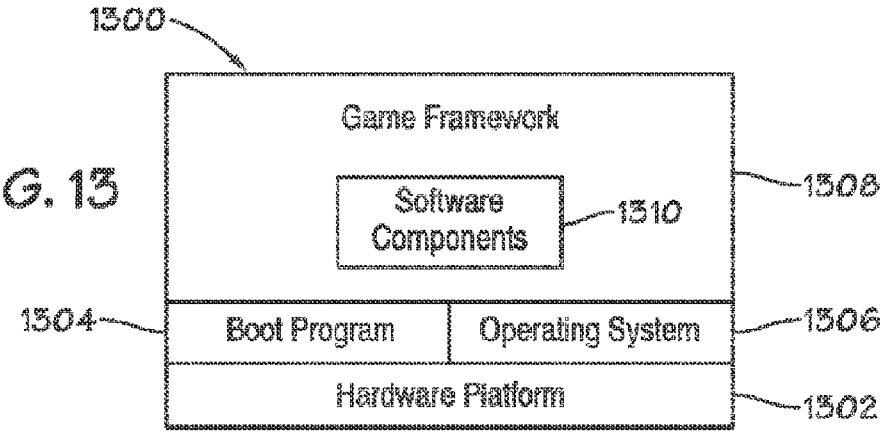
FIG. 13 depicts a block diagram of an example architecture for a wagering game assembly as described herein.

Referring now to FIG. 13, there is illustrated a block diagram of an architecture for a wagering game machine 1300, according to example embodiments of the inventive subject matter. As shown in FIG. 13, the wagering game architecture includes a hardware platform 1302, a boot program 1304, an operating system 1306, and a game framework 1308 that includes one or more wagering game software components 1310. In various embodiments, the hardware platform 1302 may include a thin-client, thick-client, or some intermediate derivation. The hardware platform 1302 may also be configured to provide a virtual client. The boot program 1304 may include a basic input/output system (BIOS) or other initialization program that works in conjunction with the operation system 1306 to provide a software interface to the hardware platform 1302. The game framework 1308 may include standardized game software components either independent or in combination with specialized or customized game software components that are designed for a particular wagering game. In one example embodiment, the wagering game software components 1310 may include software operative in connection with the hardware platform 1302 and operating system 1306 to present wagering games, such as video poker, video black jack, video slots, video lottery, etc., in whole or part. According to another example embodiment, the software components 1310 may include software operative to accept a wager from a player. According to another example embodiment, one or more of the software components 1310 may be provided as part of the operating system 1306 or other software used in the wagering game system 1300 (e.g., libraries, daemons, common services, etc.).

Example Wagering Game Network

Figure 14:
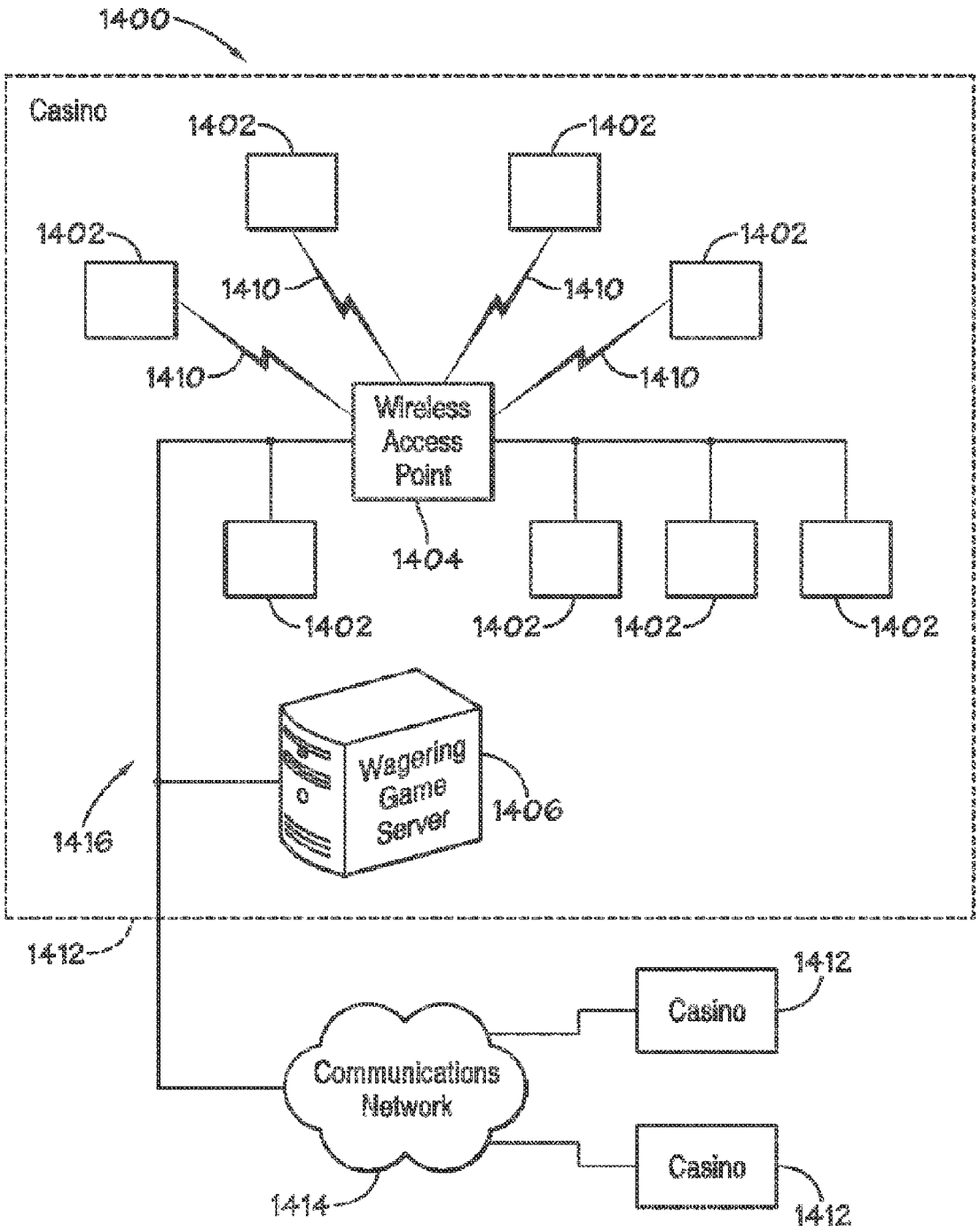
FIG. 14 depicts an example wagering game network, as may be utilized with a wagering game assembly as described herein.

While FIGS. 12 and 13 describe example embodiments of a wagering game machine architecture, FIG. 14 shows how a plurality of wagering game machines can be connected in a wagering game network 1400, according to example embodiments of the invention. As shown in FIG. 14, the example wagering game network 1400 includes not only a plurality of wagering game machines that may within a casino, but may also include multiple casinos 1412 connected to a communications network 1414.

Each of the plurality of casinos 1412 includes a local area network 1416, which may include a wireless access point 1404, wagering game machines 1402, and in some example, a wagering game server 1406 that can serve wagering games over the local area network 1416. As such, the local area network 1416 includes wireless communication links 1410 and wired communication links 1408. The wired and wireless communication links can employ any suitable connection technology, such as Bluetooth, 802.11, Ethernet, public switched telephone networks, SONET, etc. In one embodiment, the wagering game server 1406 can serve wagering games and/or distribute content to devices located in other casinos 1412 or at other locations on the communications network 1414.

The wagering game machines 1402 and wagering game server 1406 can include hardware and machine-readable media including instructions for performing the operations described herein.

The wagering game machines 1402 described herein can take any suitable form, such as floor standing models, handheld mobile units, bartop models, workstation-type console models, etc. Further, the wagering game machines 1402 can be primarily dedicated for use in conducting wagering games, or can include non-dedicated devices, such as mobile phones, personal digital assistants, personal computers, etc. In one embodiment, the wagering game network 1400 can include other network devices, such as accounting servers, wide area progressive servers, player tracking servers, and/or other devices suitable for use in connection with embodiments of the invention.

In various embodiments, wagering game machines 1402 and wagering game servers 1406 work together such that a wagering game machine 1402 may be operated as a thin, thick, or intermediate client. For example, one or more elements of game play may be controlled by the wagering game machine 1402 (client) or the wagering game server 1406 (server). Game play elements may include executable game code, lookup tables, configuration files, game outcome, audio or visual representations of the game, game assets or the like. In a thin-client example, the wagering game server 1406 may perform functions such as determining game outcome or managing assets, while the wagering game machine 1402 may be used merely to present the graphical representation of such outcome or asset modification to the user (e.g., player). In a thick-client example, game outcome may be determined locally (e.g., at the wagering game machine 1402) and then communicated to the wagering game server 1406 for recording or managing a player's account.

Similarly, functionality not directly related to game play may be controlled by the wagering game machine 1402 (client) or the wagering game server 1406 (server) in embodiments. For example, power conservation controls that manage a display screen's light intensity may be managed centrally (e.g., by the wagering game server 1406) or locally (e.g., by the wagering game machine 1402). Other functionality not directly related to game play may include presentation of advertising, software or firmware updates, system quality or security checks, etc.

GENERAL

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A wagering game assembly, comprising:

an electrically responsive touch screen configured to display an image to a player of a casino wagering game, and further configured to receive an electrical stimulus as an input to the casino wagering game;

a first, free-standing, moveable electronic input device (EID) configured to provide the electrical stimulus to the electrically responsive touch screen as the input to the casino wagering game, the first EID having a contact surface and a plurality of electrical contacts proximate the contact surface, the plurality of electrical contacts operatively arranged in a predetermined pattern to further provide machine-determinable differences that uniquely identify the first EID with respect to a second EID in use at the wagering game assembly when the first EID is in contact with the electrically responsive touch screen.

2. The wagering game assembly of claim 1, wherein the first EID is configured to provide the electrical stimulus only when the player contacts the first EID.

3. The wagering game assembly of claim 1, wherein the machine-determinable differences associate a player identity with the first EID.

4. The wagering game assembly of claim 1, wherein the first EID provides a first input to the casino wagering game as a result of the first EID being placed at a first location on the electrically responsive touch screen, and provides a second, different input to the casino wagering game as a result of the first EID being placed at a second, different location on the electrically responsive touch screen.

5. The wagering game assembly of claim 2, wherein the first EID further comprises a mechanically movable switch member, and wherein the first EID provides the electrical stimulus in response to movement of the switch member by the player.

6. The wagering game assembly of claim 1, wherein the first EID further comprises a mechanically movable switch member, and wherein the first EID provides said electrical stimulus in response to contact of the player with the first EID, and wherein the first EID provides a further electrical stimulus in response to movement of the switch member by the player.

7. A first electronic input device (EID) for use with a wagering game assembly including an electrically responsive, multi-touch touch screen, comprising, a body member having at least one generally planar contact surface, configured to allow the body member to stand in a fixed position when the contact surface is placed on a planar surface of the electrically responsive, multi-touch touch screen;

a plurality of electrical conductor surfaces proximate the contact surface, each electrical conductor surface placed to enable communication of an electrical stimulus from the conductor surface to the electrically responsive, multi-touch touch screen to provide an input to the wagering game assembly, the plurality of electrical conductor surfaces being operatively arranged in a predetermined pattern to further provide machine-determinable differences that uniquely identify the first EID with respect to a second EID in use at the wagering game system; and at least one electrical input contact in electrical communication with at least one electrical conductor surface.

8. The first EID of claim 7, wherein the at least one electrical input contact is disposed on one or more external surfaces of the first EID and is arranged to establish electrical contact with a user when the user grasps the first EID.

9. The first EID of claim 7, wherein the first EID provides a first input to a casino wagering game as a result of the first EID being placed at a first location on the electrically responsive, multi-touch touch screen, and provides a second, different input to the casino wagering game as a result of the first EID being placed at a second, different location on the electrically responsive, multi-touch touch screen.

10. The first EID of claim 7, wherein the first EID further comprises:

a contact in electrical communication with a reference potential; and a switch assembly comprising at least one movable switch element, wherein the movable switch element is movable between a first position and a second position, and wherein movement of the switch element to the second position will establish communication between the reference potential and at least one electrical conductor surface.

11. The first EID of claim 7, wherein the machine-determinable differences associate the player identity with the first EID.

12. A method of operating a casino wagering game including an electrically responsive touch screen, comprising the acts of:

receiving at least a first multi-touch input to the casino wagering game from a player of the casino wagering game, the first multi-touch input received through the electrically responsive touch screen, wherein the first multi-touch input is an electrical stimulus and is received through a first movable game piece associated with the casino wagering game, wherein the first multi-touch is received at a first location, and wherein the first multi-touch input is received in the absence of physical contact between the player and the electrically responsive touch screen proximate the first location;

in response to receiving the first multi-touch input, establishing at least a first parameter of the game configuration and determining the orientation of the first movable game piece in reference to the first multi-touch input; and operating the casino wagering game in accordance with the first established parameter and the determined orientation of the first movable game piece.

13. The method of claim 12, wherein the electrical stimulus results from electrical engagement between the player's body and the first movable game piece.

14. The method of claim 12, wherein the electrical stimulus results from electrical communication between the first movable game piece and a reference voltage.

15. The method of claim 14, wherein the reference voltage is supplied through an electrical conductor from a location external to the first movable game piece.

16. The method of claim 12, wherein the first movable game piece includes a player actuable switch, and wherein the at least one electrical stimulus results from electrical communication with a voltage potential supplied through an electrical conductor in response to a player actuation of the switch.

17. The method of claim 12, wherein the established game configuration comprises at least one of a player's wager, a game play format, an audio presentation, and a visual presentation.

18. The method of claim 12, further comprising the acts of:

receiving at least a second input to the casino wagering game from a second player of the casino wagering game, the second input received through the electrically responsive touch screen, wherein the second input is an electrical stimulus and is received through a second movable game piece associated with the casino wagering game and is received at a second location, and the second input is received in the absence of physical contact between the second player and the touch screen proximate that second location;

in response to receiving the second input, establishing at least a second parameter of the game configuration; and operating the casino wagering game in accordance with the first and second established parameters.

19. The method of claim 18, wherein the second player input is a multi-touch input comprising a plurality of touch screen contact locations, and wherein the method further comprises the acts of determining the orientation of the second movable game piece, in reference to the plurality of touch screen contact locations associated with each of those movable game pieces.

20. A method of operating a wagering game machine that includes a touch screen, comprising the acts of:

receiving a first input to the wagering game machine from a player of a casino wagering game, the first input received through the touch screen as an electrical stimulus, and received through an electrical input device (EID) in the absence of physical contact between the player and the touch screen proximal the EID, the EID including a plurality of electrically conductive pads arranged to provide electrical stimulus to the touch screen, and wherein the first input is based on at least one of an electronically recorded association between the player and the electrical input device and the placement location of the electrical input device on the touch screen;

receiving a second input to the wagering game machine from the player of the casino wagering game, the second input received through the touch screen as an electrical stimulus, and received through the electrical input device, wherein the second input is received as a result of user actuation of switching functionality in the electrical input device, wherein the first input is generated through use of at least one electrically conductive pad that is not used in providing the second input; and executing the casino wagering game to an outcome in reference to the first and second inputs.

21. The method of operating a wagering game machine of claim 20, wherein the electronically recorded association between the player and the electrical input device is established in the casino wagering game machine.

22. The method of operating a wagering game machine of claim 20, wherein the switching functionality in the electrical input device is implemented at least in part through use of a mechanical switch including a movable switch member.

* * * * *